US011162047B2

(12) United States Patent
Champagne et al.

(10) Patent No.: US 11,162,047 B2
(45) Date of Patent: Nov. 2, 2021

(54) LUBRICATING COMPOSITION COMPRISING A DIESTER

(71) Applicant: Total Marketing Services, Puteaux (FR)

(72) Inventors: Nicolas Champagne, Caluire-et-Cuire (FR); Gael Robineau, Lyons (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/635,665

(22) PCT Filed: Jul. 31, 2018

(86) PCT No.: PCT/EP2018/070745
§ 371 (c)(1),
(2) Date: Jan. 31, 2020

(87) PCT Pub. No.: WO2019/025446
PCT Pub. Date: Feb. 7, 2019

(65) Prior Publication Data

US 2021/0122992 A1 Apr. 29, 2021

(30) Foreign Application Priority Data

Aug. 3, 2017 (FR) ..... 1757485

(51) Int. Cl.

| | |
|---|---|
| ***C10M 129/74*** | (2006.01) |
| ***C10M 101/00*** | (2006.01) |
| ***C10M 107/00*** | (2006.01) |
| *C10N 30/00* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/18* | (2006.01) |
| *C10N 40/25* | (2006.01) |
| *C10N 70/00* | (2006.01) |

(52) U.S. Cl.
CPC ..... *C10M 129/74* (2013.01); *C10M 101/00* (2013.01); *C10M 107/00* (2013.01); *C10M 2207/283* (2013.01); *C10N 2030/02* (2013.01); *C10N 2030/04* (2013.01); *C10N 2030/06* (2013.01); *C10N 2030/10* (2013.01); *C10N 2030/18* (2013.01); *C10N 2030/54* (2020.05); *C10N 2040/25* (2013.01); *C10N 2070/00* (2013.01)

(58) Field of Classification Search
CPC ..... C10M 129/74; C10M 105/38; C10M 2207/283; C10M 2207/2835; C10M 101/00; C10M 107/00; C10N 2030/54; C10N 2030/02; C10N 2030/04; C10N 2030/06; C10N 2030/10; C10N 2030/18; C10N 2040/25; C10N 2070/00
See application file for complete search history.

(56) References Cited

U.S. PATENT DOCUMENTS

| | | | | |
|---|---|---|---|---|
| 4,891,161 | A * | 1/1990 | Tanikawa | C10M 105/38 508/501 |
| 2001/0007851 | A1 | 7/2001 | Gao | |
| 2002/0035043 | A1* | 3/2002 | Yokota | C10M 129/04 508/485 |
| 2006/0019840 | A1* | 1/2006 | Kawahara | C10M 169/04 508/280 |
| 2007/0037716 | A1* | 2/2007 | Tamoto | C10M 129/74 508/506 |
| 2009/0186784 | A1* | 7/2009 | Diggs | C10M 167/00 508/155 |
| 2012/0329689 | A1* | 12/2012 | Rebrovic | C10M 171/008 508/273 |
| 2014/0314351 | A1* | 10/2014 | Fujiura | C10M 105/38 384/120 |
| 2014/0342961 | A1* | 11/2014 | Miller | C10M 111/02 508/496 |
| 2015/0247104 | A1* | 9/2015 | Brekan | C10M 169/042 508/496 |
| 2018/0134983 | A1* | 5/2018 | Broutin | C08L 71/02 |
| 2019/0002790 | A1* | 1/2019 | Sanson | C10M 145/14 |

FOREIGN PATENT DOCUMENTS

| | | | |
|---|---|---|---|
| EP | 2913386 | A1 | 9/2015 |
| EP | 3124580 | A1 | 2/2017 |
| FR | 1204644 | A | 1/1960 |
| GB | 716086 | A | 9/1954 |

OTHER PUBLICATIONS

International Search Report (ISR) for PCT/EP2018/070745 dated Oct. 19, 2018 (7 pages).

* cited by examiner

*Primary Examiner* — Ellen M McAvoy
(74) *Attorney, Agent, or Firm* — Shumaker, Loop & Kendrick, LLP

(57) ABSTRACT

Lubricating compositions for motor vehicles are disclosed. The lubricating composition is of grade according to the SAE J300 classification defined by the formula (X)W(Y), wherein X represents 0 or 5; and Y represents an integer ranging from 4 to 20; and comprises at least one diester of formula $R^a$—C(O)—O—([C(R)$_2$]$_n$—O)$_s$—C(O)—$R^b$ (I). The composition may be used as a lubricant for an engine, in particular a vehicle engine, to reduce the fuel consumption of the engine and to improve engine cleanliness.

16 Claims, No Drawings

LUBRICATING COMPOSITION COMPRISING A DIESTER

TECHNICAL FIELD AND BACKGROUND

The present invention concerns the field of lubricating compositions for engines, in particular for motor vehicle engines. It aims in particular to offer a lubricating composition with improved performance notably in terms of improved engine cleanliness and reduced fuel consumption.

Lubricating compositions, also known as "lubricants", are commonly used in engines for the main purpose of reducing the frictional forces between the various metal parts moving within the engines. In addition, they are effective in preventing premature wear and tear or even damage to these parts, especially to their surfaces.

For this purpose, a lubricating composition is classically composed of a base oil to which are usually associated several additives dedicated to stimulating the lubricating performance of the base oil, such as friction modifying additives, but also to providing additional performance. For example, detergent additives are very often considered in order to avoid the formation of deposits on the surface of metal parts by dissolving oxidation and combustion by-products.

For obvious reasons, improving the performance of lubricants is a constant concern. In particular, in order to meet increasing environmental requirements, there is a growing interest in reducing the fuel consumption of vehicles.

In this respect, it is known that lubricating compositions are an effective means of influencing fuel consumption through their impact on the frictional forces generated between the different parts of an engine. In particular, it is known that the quality of the base oils, alone or in combination with viscosity index improving polymers and friction modifying additives, is particularly decisive in achieving fuel economy.

For example, so-called "Fuel-Eco" (FE, for fuel economy) lubricating compositions have already been developed. The more or less fluid grade of the base oil is a determining factor in accessing such "Fuel-Eco" lubricants.

In addition, some monoesters used in lubricants are solid at room temperature, which poses problems of cold pumpability of lubricants and, furthermore, such lubricants do not meet the criteria of SAE J300.

Also known, from patent application EP 2913386, is a lubricating composition comprising from 50 to 97 wt % of a base oil and from 3 to 50 wt % of 2-ethylhexyl sebacate having Fuel-Eco properties.

Engine breakdowns are most often the result of engine fouling. It is in fact desirable to have lubricating compositions that improve engine cleanliness.

The invention aims precisely at offering a lubricating composition, in particular dedicated to a vehicle engine, which combines both improved properties in terms of fuel economy and of engine cleanliness.

Against all expectations, the inventors have discovered that it is possible to access lubricating compositions, whose efficiency is increased in terms of improved engine cleanliness, provided that the use of a specific diester is considered, and which offer performances in terms of fuel consumption savings equivalent, or even superior, to those of so-called "Fuel-Eco" lubricating compositions.

The present invention thus concerns, according to a first of its aspects, a lubricating composition of grade according to the SAE J300 classification defined by the formula (X)W(Y), wherein X represents 0 or 5; and Y represents an integer ranging from 4 to 20, said composition comprising at least one diester of formula (I):

$$R^a—C(O)—O—([C(R)_2]_n—O)_s—C(O)—R^b \quad (I)$$

wherein:

R independently represent a hydrogen atom or a linear or branched ($C_1$-$C_5$)alkyl group, in particular a methyl, ethyl or propyl group, notably methyl;

s is 1, 2, 3, 4, 5 or 6;

n is 1, 2 or 3; provided that when s is different from 1, n may be the same or different; and $R^a$ and $R^b$, which may be identical or different, independently represent saturated or unsaturated, linear or branched hydrocarbon groups having a linear chain of 6 to 18 carbon atoms;

provided that, when s is 2 and n, which are identical, are 2, at least one of the groups R represents a linear or branched ($C_1$-$C_5$)alkyl group; and provided that, when s is 1 and n is 3, at least one of the groups R bonded to the carbon in the beta position of the oxygen atoms of the ester functions represents a hydrogen atom.

Preferably, s is 1, 2 or 3, in particular s is 1 or 2.

Preferably, n is 2 or 3, in particular n is 2.

According to a particular embodiment, the diester of formula (I) according to the invention is a diester of the following formula (I'):

$$R^a—C(O)—O—([C(R)_2]_n—O)—([C(R')_2]_m—O)_{s-1}—C(O)—R^b \quad (I')$$

wherein:

R and R' independently represent a hydrogen atom or a linear or branched ($C_1$-$C_5$)alkyl group, in particular a methyl, ethyl or propyl group, notably a methyl group;

s is 1, 2 or 3, in particular s is 1 or 2;

n is 2;

m is 2;

$R^a$ and $R^b$, which may be identical or different, independently represent saturated or unsaturated, linear or branched hydrocarbon groups having a linear chain of 6 to 18 carbon atoms;

provided that, when s is 2, at least one of the groups R or R' represents a linear or branched ($C_1$-$C_5$)alkyl group.

Advantageously, at least one of the groups R or R' in the diester of formula (I') represents a linear or branched ($C_1$-$C_5$)alkyl, in particular ($C_1$-$C_4$)alkyl group, more preferentially methyl, ethyl or propyl; advantageously methyl.

The diesters of formula (I), in particular of formula (I'), are described in more detail hereinbelow.

Preferably, $R^a$ and $R^b$ in the above-mentioned formulae (I) and (I') have a linear sequence of 7 to 14 carbon atoms, in particular 8 to 12 carbon atoms, more particularly 8 to 11 carbon atoms and notably 8 to 10 carbon atoms. In particular, $R^a$ and $R^b$ both represent n-octyl or n-dodecanoyl groups, preferably n-octyl.

Lubricating compositions incorporating such a diester of formula (I), in particular of the above-mentioned formula (I'), prove particularly effective for use as a lubricant for an engine, in particular a vehicle engine.

The present invention thus concerns, according to another of its aspects, the use of a composition as described above as a lubricant for an engine, in particular a vehicle engine.

In particular, as shown in the following examples, the inventors observed that a lubricating composition of grade according to the SAE J300 classification defined by the formula (X)W(Y), wherein X represents 0 or 5; and Y represents an integer ranging from 4 to 20 and containing at least one diester in accordance with the invention manifests improved properties compared with those observed with lubricating compositions comprising monoesters or diesters other than those of the invention or triesters, in terms of both reduced fuel consumption ("Fuel-Eco" properties) and engine cleanliness.

Admittedly, document GB 716086 dated 1951 proposes the use of a diester in lubricating compositions. However, this use is considered in a very different context from that of the invention. First of all, the lubricating compositions considered in patent GB 716086 are not in accordance with those considered according to the invention and notably intended for use in aircraft engines which are exposed to very wide variations in temperature. Synthetic esters are described as being of greater interest than mineral oils in that they have high viscosity indices and flash points, and lower pour points than mineral oils of comparable viscosity.

SUMMARY

In the context of the invention, the lubricating compositions considered are of grade according to the SAE J300 classification defined by the formula (X)W(Y), wherein X represents 0 or 5; and Y represents an integer ranging from 4 to 20. This grade qualifies a selection of lubricating compositions specifically intended for a motor vehicle engine application and which satisfy notably quantified specificities with respect to various parameters such as cold viscosity at start up, cold pumpability, kinematic viscosity at low shear rate and dynamic viscosity at high shear rate.

In an advantageous manner, the use of a diester of formula (I) as defined above, and in particular of formula (I') mentioned above, as additive in a lubricating composition of the grade considered according to the invention makes it possible to reduce the fuel consumption of an engine. In other words, the lubricating compositions of the invention meet the qualification of "Fuel-Eco", in that they provide access to reduced fuel consumption.

Thus, according to another of its aspects, the invention further aims at the use of a diester of formula (I) as defined above, and in particular of formula (I') mentioned above, as additive in a lubricating composition of grade according to the SAE J300 classification defined by the formula (X)W(Y), wherein X represents 0 or 5, and Y represents an integer ranging from 4 to 20, and dedicated to an engine, in particular to a vehicle engine, to reduce the fuel consumption of the engine.

Also, as illustrated in the following examples, the use of such a diester, having good detergent properties, in a lubricating composition according to the invention advantageously improves engine cleanliness.

Thus, the invention concerns, according to yet another of its aspects, the use of a diester of formula (I) as defined above, and in particular of formula (I') mentioned above, as additive in a lubricating composition of grade according to the SAE J300 classification defined by the formula (X)W(Y), wherein X represents 0 or 5, and Y represents an integer ranging from 4 to 20, and dedicated to an engine, in particular to a vehicle engine, to improve engine cleanliness.

DETAILED DESCRIPTION

Other features, variants and advantages of the lubricating compositions according to the invention will become clearer by reading the description and examples that follow, given by way of non-limiting illustration of the invention.

Hereinbelow, the expressions "between . . . and . . . ", "from . . . to . . . " and "varying from . . . to . . . " are equivalent and are intended to mean that the bounds are included, unless otherwise specified.

Unless otherwise specified, the expression "including one" is to be understood as "including at least one".

Diester of General Formula (I)

As stated above, a lubricating composition according to the invention has the specificity of containing at least one diester of general formula (I)

$$R^a—C(O)—O—([C(R)_2]_n—O)_s—C(O)—R^b \quad (I)$$

wherein:

R independently represent a hydrogen atom or a linear or branched ($C_1$-$C_5$)alkyl group, in particular a methyl, ethyl or propyl group, notably methyl;

s is 1, 2, 3, 4, 5 or 6; in particular s is 1, 2 or 3 and more particularly s is 1 or 2;

n is 1, 2 or 3; in particular n is 2 or 3 and more particularly n is 2, it being understood that when s is different from 1, n may be the same or different; and $R^a$ and $R^b$, which may be identical or different, independently represent saturated or unsaturated, linear or branched hydrocarbon groups having a linear chain of 6 to 18 carbon atoms;

provided that, when s is 2 and n, which are identical, are 2, at least one of the groups R represents a linear or branched ($C_1$-$C_5$)alkyl group; and provided that, when s is 1 and n is 3, at least one of the groups R bonded to the carbon in the beta position of the oxygen atoms of the ester functions represents a hydrogen atom.

Hereinbelow, a diester of formula (I) according to the invention will be designated more simply as a diester of the invention.

Preferably, in the context of the invention:

"$C_{t-z}$", where t and z are integers, refers to a carbon chain which may have t to z carbon atoms; for example, $C_{1-4}$ refers to a carbon chain which may have 1 to 4 carbon atoms;

"alkyl" refers to a saturated linear or branched aliphatic group; for example, $C_{1-4}$-alkyl group represents a linear or branched carbon chain of 1 to 4 carbon atoms, more particularly methyl, ethyl, propyl, isopropyl, butyl, isobutyl, tert-butyl.

Preferably, in the above-mentioned formula (I), when s is different from 1, all n are the same.

In particular, n in the above-mentioned formula (I) is 2 or 3, and more particularly n is 2.

Preferably, s in the above-mentioned formula (I) is 1, 2 or 3, preferably s is 1 or 2.

Preferably, at least one of the groups R represents a linear or branched ($C_1$-$C_5$)alkyl, in particular ($C_1$-$C_4$)alkyl group, more preferentially methyl, ethyl or propyl; advantageously methyl.

According to a particularly preferred embodiment, the diester of formula (I) according to the invention may be more particularly a diester of the following formula (I'):

$$R^a—C(O)—O—([C(R)_2]_n—O)—([C(R')_2]_m—O)_{s-1}—C(O)—R^b \quad (I')$$

wherein:

R and R' independently represent a hydrogen atom or a linear or branched ($C_1$-$C_5$)alkyl group, in particular a methyl, ethyl or propyl group, notably a methyl group;

s is 1, 2 or 3, in particulars is 1 or 2;

n is 2;

m is 2;

$R^a$ and $R^b$, which may be identical or different, independently represent saturated or unsaturated, linear or branched hydrocarbon groups having a linear chain of 6 to 18 carbon atoms;

provided that, when s is 2, at least one of the groups R or R' represents a linear or branched ($C_1$-$C_5$)alkyl group.

Preferably, a diester according to the invention is of formula (I') wherein at least one of the R or R' represents a linear or branched ($C_1$-$C_5$)alkyl, in particular ($C_1$-$C_4$)alkyl group, more preferentially methyl, ethyl or propyl; advantageously methyl.

According to a variant embodiment, s in the above-mentioned formula (I) or (I') is 2.

In particular, the diester according to the invention may have the following formula (I'a):

$$R^a—C(O)—O—([C(R)_2]_n—O)—([C(R')_2]_m—O)—C(O)—R^b \quad (I'a)$$

wherein:

R and R' independently represent a hydrogen atom or a linear or branched ($C_1$-$C_5$)alkyl group, in particular a methyl, ethyl or propyl group, advantageously methyl;

n is 2;

m is 2;

$R^a$ and $R^b$, which may be identical or different, independently represent saturated or unsaturated, linear or branched hydrocarbon groups having a linear chain of 6 to 18 carbon atoms;

provided that at least one of the groups R or R' represents a linear or branched ($C_1$-$C_5$)alkyl group, in particular methyl, ethyl or propyl, advantageously methyl.

Preferably, at least one of the groups R represents a linear or branched ($C_1$-$C_5$)alkyl group, in particular a methyl, ethyl or propyl group, advantageously methyl; and at least one of the R' represents a linear or branched ($C_1$-$C_5$)alkyl group, in particular a methyl, ethyl or propyl group, advantageously methyl.

Even more preferably, the diester of the invention may be of formula (I'a) wherein one of the groups R represents a linear or branched ($C_1$-$C_5$)alkyl group, in particular a methyl, ethyl or propyl group, advantageously methyl; and one of the groups R' represents a linear or branched ($C_1$-$C_5$)alkyl group, in particular a methyl, ethyl or propyl group, advantageously methyl; the other groups R and R' representing hydrogen atoms.

In other words, according to a particular embodiment, the diester of the invention may have the following formula (I"a):

$$R^a—C(O)—O—CHR^1—CHR^2—O—CHR^3—CHR^4—O—C(O)—R^b \quad (I"a)$$

wherein:

one of the groups $R^1$ and $R^2$ represents a linear or branched ($C_1$-$C_5$)alkyl group, the other representing a hydrogen atom;

one of the groups $R^3$ and $R^4$ represents a linear or branched ($C_1$-$C_5$)alkyl group, the other representing a hydrogen atom; and $R^a$ and $R^b$, which may be identical or different, are as defined above.

In particular, the diester of the invention may be of formula (I"a) wherein:

one of the groups $R^1$ and $R^2$ represents a methyl, ethyl or propyl group, advantageously methyl, the other representing a hydrogen atom; and one of the groups $R^3$ and $R^4$ represents a methyl, ethyl or propyl group, advantageously methyl, the other representing a hydrogen atom.

According to another variant embodiment, s in the above-mentioned formula (I) or (I') is 1.

In other words, the diester according to the invention may be of the following formula (I'b):

$$R^a—C(O)—O—([C(R)_2]_n—O)—C(O)—R^b \quad (I'b)$$

wherein:

R independently represent a hydrogen atom or a linear or branched ($C_1$-$C_5$)alkyl group, in particular a methyl, ethyl or propyl group, advantageously methyl;

n is 2;

$R^a$ and $R^b$, which may be identical or different, independently represent saturated or unsaturated, linear or branched hydrocarbon groups having a linear chain of 6 to 18 carbon atoms.

Preferably, in the above-mentioned formula (I'b), at least one of the R represents a linear or branched ($C_1$-$C_5$)alkyl group, in particular a methyl, ethyl or propyl group, advantageously methyl.

In particular, the diester of the invention may be of formula (I'b) wherein one of the groups R represents a linear or branched ($C_1$-$C_5$)alkyl group, in particular a methyl, ethyl or propyl group, advantageously methyl, the others representing hydrogen atoms.

According to yet another variant embodiment, the diester of the invention may be of formula (I) wherein s is 3.

Preferably, in the context of this variant embodiment, n, which are identical, are equal to 2. Preferably, for each of the groups —($[C(R)_2]_n$—O)—, one of the R represents a linear or branched ($C_1$-$C_5$)alkyl group, in particular methyl, ethyl or propyl, advantageously methyl, the others representing hydrogen atoms.

As indicated above, $R^a$ and $R^b$ in formula (I), (I'), (I'a), (I"a) and (I'b) above, which may be identical or different, represent saturated or unsaturated, linear or branched hydrocarbon groups having a linear chain of 6 to 18 carbon atoms.

"Hydrocarbon" group means any group having a carbon atom directly attached to the rest of the molecule and having mainly an aliphatic hydrocarbon character.

Preferably, $R^a$ and $R^b$ have a linear chain of 7 to 17 carbon atoms, in particular 7 to 14 carbon atoms, in particular 8 to 12 carbon atoms, in particular 8 to 11 carbon atoms, notably 8 to 10 carbon atoms.

"Linear sequence of t to z carbon atoms" means a saturated or unsaturated, preferably saturated, carbon chain comprising t to z carbon atoms in succession, the carbon atoms optionally present at the branches of the carbon chain not being taken into account in the number of carbon atoms (t-z) constituting the linear sequence.

According to a particular embodiment, in formula (I), (I'), (I'a), (I"a) or (I'b) above, $R^a$ and $R^b$, which may be identical or different, are derived from plant, animal or petroleum origin.

According to a particular embodiment, in the above-mentioned formula (I), (I'), (I'a), (I"a) or (I'b), $R^a$ and $R^b$, which may be identical or different, represent saturated groups.

According to another particularly preferred embodiment, in the above-mentioned formula (I), (I'), (I'a), (I"a) or (I'b), $R^a$ and $R^b$, which may be identical or different, represent linear groups.

In particular, $R^a$ and $R^b$ represent $C_6$ to $C_{18}$, in particular $C_7$ to $C_{17}$, notably $C_7$ to $C_{14}$, preferably $C_8$ to $C_{12}$ and more preferentially $C_8$ to $C_{11}$, notably $C_8$ to $C_{10}$, saturated linear hydrocarbon groups.

According to another particularly preferred embodiment, in the above-mentioned formula (I), (I'), (I'a), (I''a) or (I'b), $R^a$ and $R^b$ represent linear $C_6$ to $C_{18}$, in particular $C_7$ to $C_{17}$, notably $C_7$ to $C_{14}$, preferably $C_8$ to $C_{12}$ and more preferentially $C_8$ to $C_{11}$, notably $C_8$ to $C_{10}$ alkyl groups.

In particular, $R^a$ and $R^b$ are identical.

Preferably, $R^a$ and $R^b$ both represent n-octyl or n-undecyl groups, preferably n-octyl.

The diesters of formula (I) according to the invention may be commercially available or prepared according to methods of synthesis described in the literature and known to the skilled person. These methods of synthesis involve more particularly an esterification reaction between a diol compound of the formula $HO—([C(R)_2]_n—O)_s—OH$ and compounds of the formula $R^a—COOH$ and $R^b—COOH$, where $R^a$ and $R^b$, which may be identical or different, are as defined above.

Of course, it is up to the skilled person to adjust the conditions of synthesis to obtain the diesters according to the invention.

By way of examples, diesters of the above-mentioned formula (I), in particular of the above-mentioned formula (I'), are obtainable by esterification reaction between a monopropylene or polypropylene glycol, in particular monopropylene glycol (MPG) or dipropylene glycol (DPG), and one or more suitable carboxylic acids $R^a—COOH$ and $R^b—COOH$.

By way of example, a diester or mixture of diesters of formula (I') as defined above, where:

s is 2, one of the groups R representing a linear or branched $(C_1-C_5)$alkyl group, in particular a methyl, ethyl or propyl group, advantageously methyl, the others representing hydrogen atoms; and one of the groups R' representing a linear or branched $(C_1-C_5)$alkyl group, in particular a methyl, ethyl or propyl group, advantageously methyl, the others representing hydrogen atoms, is obtainable by an esterification reaction between dipropylene glycol (DPG) and one or more suitable carboxylic acids $R^a—COOH$ and $R^b—COOH$.

A diester of formula (I') as defined above, wherein s is 1, one of the groups R representing a linear or branched $(C_1-C_5)$alkyl group, in particular a methyl, ethyl or propyl group, advantageously methyl, the others representing hydrogen atoms, is obtainable by an esterification reaction between monopropylene glycol (MPG) and one or more suitable carboxylic acids $R^a—COOH$ and $R^b—COOH$.

In particular, if $R^a$ and $R^b$ both represent n-octyl or n-undecyl groups, such a diester or mixture of diesters is obtainable by an esterification reaction between monopropylene glycol or dipropylene glycol and nonanoic acid or undecanoic acid.

Lubricating Composition

The diesters of formula (I) may be mixed with one or more base oils, in particular as defined below, to form a ready-to-use lubricating composition. Alternatively, they may be added alone, or in admixture with one or more other additives, as defined below, as additives to be added to a mixture of base oils to improve the properties of the lubricating composition.

It is understood that a diester of formula (I) in accordance with the invention may be used in a lubricating composition alone or in combination with one or more other diesters of formula (I).

Advantageously, a lubricating composition according to the invention can thus comprise a mixture of diesters of formula (I) consisting of at least 50 mass % of one or more diesters of formula (I) for which $R^a$ and $R^b$ represent $C_8$ to $C_{10}$ saturated linear hydrocarbon groups, in particular $C_{8-10}$-alkyl groups.

According to a particular embodiment, a lubricating composition according to the invention comprises at least as diester of formula (I) in accordance with the invention, a diester or mixture of diesters resulting from the esterification reaction between monopropylene glycol (MPG) or dipropylene glycol (DPG) and a $C_7$ to $C_{19}$ carboxylic acid, in particular between MPG or DPG and nonanoic or undecanoic acid.

Preferably, a lubricating composition according to the invention comprises at least as diester of formula (I) in accordance with the invention, a diester or mixture of diesters resulting from the esterification reaction between MPG or DPG and nonanoic acid.

It is up to the skilled person to adapt the content of diester(s) of formula (I) according to the invention to be used in a lubricating composition.

In general, a lubricating composition according to the invention may comprise from 1 to 30 wt % diester(s) of formula (I), based on the total weight of the composition. In particular, it may comprise from 5 to 30 wt % diester(s) of formula (I), in particular from 5 to 25 wt %, more particularly from 10 to 25 wt %, still more particularly from 10 to 20 wt %.

A lubricating composition according to the invention may comprise, in addition to one or more diesters of formula (I) as defined above, one or more base oils, as well as additives, in particular as defined hereinbelow.

Base Oils

A lubricating composition according to the invention may further comprise one or more base oils.

These base oils can be selected from the base oils conventionally used in the field of lubricating oils, such as mineral, synthetic or natural, animal or vegetable oils or mixtures thereof.

The base oils used in the lubricating compositions according to the invention may be in particular oils of mineral or synthetic origin belonging to groups I to V according to the classes defined in the API classification (Table A), or their equivalents according to the ATIEL classification, or mixtures thereof.

TABLE A

| | Saturates content | Sulfur content | Viscosity Index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | Polyalphaolefins (PAO) | | |
| Group V | Esters and other bases not included in Groups I to IV | | |

Mineral base oils include all types of bases obtained by atmospheric and vacuum distillation of crude oil, followed by refining operations such as solvent extraction, deasphalting, solvent dewaxing, hydrotreating, hydrocracking, hydroisomerization and hydrofinishing.

Synthetic base oils can be esters of carboxylic acids and alcohols or polyalphaolefins. Polyalphaolefins used as base oils are for example obtained from monomers with 4 to 32 carbon atoms, for example from decene, octene or dodecene, and have a viscosity at 100° C. of between 1.5 and 15 $mm^2$-$s^{-1}$ according to ASTM D445. Their average molecular weight is generally between 250 and 3000 according to ASTM D5296.

Mixtures of synthetic and mineral oils can also be used.

There is generally no limitation as to the use of different lubricating bases for making the lubricating compositions according to the invention, except that they must have properties, notably viscosity, viscosity index, sulfur content, oxidation resistance, suitable for use in vehicle engines. Of course, they must also not affect the properties provided by the oil or the diesters of general formula (I) with which they are combined.

Preferably, a lubricating composition according to the invention comprises a base oil selected from Group II, III and IV of the API classification.

In particular, a lubricating composition according to the invention may comprise at least one Group III base oil.

A lubricating composition according to the invention may comprise at least 50 wt % base oil(s) based on its total weight, in particular at least 60 wt % base oil(s), and more particularly between 60 and 99 wt % base oil(s).

Preferably, the Group III oil(s) represent(s) at least 50 wt %, in particular at least 60 wt % of the total weight of the base oils of the composition.

Additives

A lubricating composition according to the invention may further comprise all types of additives suitable for use in a lubricant for a vehicle engine, in particular a motor vehicle engine.

These additives may be introduced individually and/or in the form of a mixture similar to those already available on the market for commercial vehicle engine lubricant formulations with performance levels as defined by the ACEA (European Automobile Manufacturers' Association) and/or API (American Petroleum Institute), which are well known to the skilled person.

A lubricating composition according to the invention may thus comprise one or more additives selected from friction modifying additives, anti-wear additives, extreme pressure additives, detergent additives, antioxidant additives, viscosity index (VI) improvers, pour point depressants (PPD), dispersing agents, antifoam agents, thickeners, and mixtures thereof.

As far as friction-modifying additives are concerned, they may be selected from compounds providing metallic elements and ash-free compounds.

Among the compounds providing metallic elements, mention may be made of complexes of transition metals such as Mo, Sb, Sn, Fe, Cu, Zn whose ligands may be hydrocarbon compounds comprising oxygen, nitrogen, sulfur or phosphorus atoms.

Ash-free friction modifier additives are generally of organic origin and may be selected from fatty acid and polyol monoesters, alkoxylated amines, alkoxylated fatty amines, fatty epoxides, borate fatty epoxides, fatty amines or fatty acid glycerol esters. According to the invention, fatty compounds comprise at least one hydrocarbon group containing from 10 to 24 carbon atoms.

According to an advantageous variant, a lubricating composition according to the invention comprises at least one friction-modifying additive, in particular based on molybdenum.

In particular, molybdenum-based compounds can be selected from molybdenum dithiocarbamates (Mo-DTC), molybdenum dithiophosphates (Mo-DTP), and mixtures thereof.

A lubricating composition according to the invention comprises at least one Mo-DTC compound and at least one Mo-DTP compound. A lubricating composition may notably include a molybdenum content between 1000 and 2500 ppm.

Advantageously, such a composition offers the advantage of additional fuel savings.

Advantageously, a lubricating composition according to the invention may comprise from 0.01 to 5 wt %, preferably from 0.01 to 5 wt %, more particularly from 0.1 to 2 wt % or still more particularly from 0.1 to 1.5 wt %, based on the total weight of the lubricating composition, of friction-modifying additives, advantageously including at least one molybdenum-based friction-modifying additive.

As far as anti-wear and extreme pressure additives are concerned, they are more particularly dedicated to protecting rubbing surfaces by forming a protective film adsorbed on these surfaces. There are a wide variety of anti-wear additives.

Particularly suitable for lubricating compositions according to the invention are anti-wear additives selected from polysulfide additives, sulfur-containing olefin additives or phospho-sulfur additives such as metal alkylthiophosphates, in particular zinc alkylthiophosphates, and more specifically zinc dialkyldithiophosphates or ZnDTP. The preferred compounds are of formula $Zn((SP(S)(OR)(OR'))_2$, wherein R and R', which may be identical or different, independently represent an alkyl group, preferably containing from 1 to 18 carbon atoms.

Advantageously, a lubricating composition according to the invention may comprise 0.01 to 6 wt %, preferentially 0.05 to 4 wt %, more preferentially 0.1 to 2 wt %, based on the total weight of the composition, of anti-wear additives and extreme pressure additives.

As far as antioxidant additives are concerned, they are essentially dedicated to delaying the degradation of the lubricating composition in service. This degradation can result in the formation of deposits, sludge or an increase in the viscosity of the lubricating composition. They act in particular as radical inhibitors or hydroperoxide destroyers. Commonly used antioxidant additives include phenolic-type antioxidants, amino-type antioxidant additives, phosphorous-sulfur antioxidant additives. Some of these antioxidant additives, for example phosphorous-sulfur antioxidant additives, can be ash generators. Phenolic antioxidant additives can be ash-free or in the form of neutral or basic metal salts. Antioxidant additives may notably be selected from sterically hindered phenols, sterically hindered phenol esters and sterically hindered phenols comprising a thioether bridge, diphenylamines, diphenylamines substituted by at least one $C_1$-$C_{12}$ alkyl group, N,N'-dialkyl-aryl-diamines and mixtures thereof.

Preferably, sterically hindered phenols are selected from compounds comprising a phenol group of which at least one carbon vicinal to the carbon bearing the alcohol function is substituted by at least one $C_1$-$C_{10}$ alkyl group, preferably a $C_1$-$C_6$ alkyl group, preferably a $C_4$ alkyl group, preferably by the tert-butyl group.

Amino compounds are another class of antioxidant additives that can be used, optionally in combination with phenolic antioxidant additives. Examples of amino compounds are aromatic amines, for example aromatic amines of the formula $NR^5R^6R^7$ wherein $R^5$ represents an optionally substituted aliphatic group or aromatic group, $R^6$ represents an optionally substituted aromatic group, $R^7$ represents a hydrogen atom, an alkyl group, an aryl group or a group of the formula $R^8S(O)_zR^9$ wherein $R^8$ represents an alkylene group or an alkenylene group, $R^9$ represents an alkyl group, an alkenyl group or an aryl group and z represents 0, 1 or 2.

Sulfurized alkyl phenols or their alkali and alkaline earth metal salts may also be used as antioxidant additives.

The lubricating composition according to the invention may contain all types of antioxidant additives known to the skilled person. Advantageously, the lubricating composition comprises at least one ash-free antioxidant additive.

Equally advantageously, a lubricating composition according to the invention may comprise from 0.1 to 2 wt %, based on the total weight of the composition, of at least one antioxidant additive.

In the case of so-called detergent additives, they generally reduce the formation of deposits on the surface of metal parts by dissolving oxidation and combustion by-products.

The detergent additives which can be used in a lubricating composition according to the invention are generally known to the skilled person. Detergent additives may be anionic compounds comprising a long lipophilic hydrocarbon chain and a hydrophilic head. The associated cation may be a metal cation of an alkali or alkaline earth metal.

Detergent additives are preferentially selected from alkali metal or alkaline earth metal salts of carboxylic acids, sulfonates, salicylates, naphthenates and phenate salts. The alkali and alkaline earth metals are preferably calcium, magnesium, sodium or barium. These metal salts generally include the metal in stoichiometric quantities or in excess, i.e. in quantities greater than the stoichiometric quantity. These are then overbased detergent additives; the excess metal providing the overbased character to the detergent additive is then usually in the form of a metal salt insoluble in the base oil, for example a carbonate, a hydroxide, an oxalate, an acetate, a glutamate, preferentially a carbonate.

A lubricating composition according to the invention may comprise 0.5 to 8 wt %, preferably 0.5 to 4 wt %, based on the total weight of the lubricating composition, of detergent additive.

Advantageously, a lubricating composition according to the invention may comprise less than 4 wt % detergent additive(s), in particular less than 2 wt %, notably less than 1 wt %, or even be free of detergent additive.

As far as pour point depressant (PPD) additives are concerned, they, by slowing down the formation of paraffin crystals, improve the cold behavior of the lubricating composition according to the invention.

As examples of pour point reducing agents, mention may be made of polyalkyl methacrylates, polyacrylates, polyarylamides, polyalkylphenols, polyalkylnaphthalenes and alkylated polystyrenes.

Dispersing agents are used to suspend and remove insoluble solid contaminants from the oxidation by-products that form when the lubricating composition is in service. They can be selected from Mannich bases, succinimides and their derivatives.

In particular, a lubricating composition according to the invention may comprise from 0.2 to 10 wt % of dispersing agent(s), based on the total weight of the composition.

Viscosity index (VI) improvers, in particular viscosity index (VI) improving polymers, ensure good cold performance and minimum viscosity at high temperatures. Examples of viscosity index-improving polymers include polymeric esters, hydrogenated or non-hydrogenated homopolymers or copolymers of styrene, butadiene and isoprene, homopolymers or copolymers of olefins, such as ethylene or propylene, polyacrylates and polymethacrylates (PMA).

In particular, a lubricating composition according to the invention may comprise from 1 to 15 wt % viscosity index improver(s) based on the total weight of the lubricating composition.

Antifoam additives can be selected from polar polymers such as polymethylsiloxanes or polyacrylates.

In particular, a lubricating composition according to the invention may comprise from 0.01 to 3 wt % antifoam additive(s) based on the total weight of the lubricating composition.

Application

The lubricating compositions according to the invention find a particularly interesting application as lubricants for an engine, in particular for a vehicle engine and more particularly for a light vehicle.

A lubricating composition according to the invention has a particularly advantageous viscosity grade.

The viscosity grade of a lubricating composition according to the invention may be notably selected from:

a grade according to the SAE J300 classification defined by formulae (II) or (III)

| | |
|---|---|
| 0 W (Y)<br>(II) | 5 W (Y)<br>(III) |

wherein Y represents an integer from 4 to 20, in particular from 4 to 16 or from 4 to 12; or a grade according to the SAE J300 classification defined by formulae (IV) or (V)

| | |
|---|---|
| (X) W 8<br>(IV) | (X) W 12<br>(V) |

wherein X represents 0 or 5.

According to a particular embodiment, the grade according to the SAE J300 classification of a lubricating composition according to the invention is selected from 0W4, 0W8, 0W12, 0W16, 0W20, 5W4, 5W8, 5W12, 5W16 and 5W20.

In particular, a lubricating composition according to the invention may have a grade according to the SAE J300 classification of 0W20 or 0W16.

Advantageously, the kinematic viscosity measured at 100° C. according to ASTM D445 of a lubricating composition according to the invention is between 3 and 15 $mm^2 \cdot s^{-1}$, in particular between 3 and 13 $mm^2 \cdot s^{-1}$.

Advantageously, the high-temperature, high-shear (HTHS) viscosity measured at 150° C. is equal to or greater than 1.7 mPa-s, preferably between 1.7 and 3.7 mPa·s, advantageously between 2.3 and 3.7 mPa·s.

The HTHS measurement is performed at high shear ($10^6$ $s^{-1}$) and 150° C. according to standard methods CEC-L-36-A-90, ASTM D4683 and ASTM D4741.

Advantageously, a lubricating composition according to the invention has a Noack volatility, determined according to ASTM D5800, less than or equal to 15%, in particular less than or equal to 14%.

As indicated above, a lubricating composition according to the invention, in particular through the use of a diester of formula (I) according to the invention, makes it possible advantageously to combine good properties in terms of both reduced fuel consumption and engine cleanliness.

The invention thus aims at the use of a diester of formula (I) according to the invention in a lubricating composition of grade according to the SAE J300 classification defined by the formula (X)W(Y), wherein X represents 0 or 5, and Y represents an integer ranging from 4 to 20, in particular dedicated to an engine, in particular to a vehicle engine.

Engine cleanliness is measured by scoring the piston fouling of the engine after an engine test using a lubricating composition to be tested, in particular in relation to a Group III base oil.

The invention will now be described by means of the following examples given, of course, by way of non-limiting illustration of the invention.

EXAMPLES

In the following examples, lubricating compositions according to the invention, and comparative compositions, for example comprising monoesters or diesters other than those of the invention, in replacement of a diester in accordance with the invention, were formulated with the following components indicated in Table 1:

The esters according to the invention and of the prior art were obtained by esterification reaction between a compound having at least two alcohol functions and at least two fatty acids, said acids being able to be identical or different.

The esters of the prior art were also obtained by esterification reaction between a fatty acid having at least two carboxylic acid functions and at least two compounds having at least one alcohol function, said alcohols being able to be identical or different.

TABLE 1

| Ester | Alcohol | Acid 1 | Acid 2 | KV 100° C. ASTM D445-97 ($mm^2/s$) of the ester |
|---|---|---|---|---|
| Diester 1 (prior art) | Neopentyl glycol | Octanoic acid | Decanoic acid | 2.51 |
| Diester 2 (prior art) | 2-Ethylhexanol | Sebacic acid | x | 3.20 |
| Diester 3 (according to the invention) | Dipropylene glycol | Nonanoic acid | x | 2.66 |
| Diester 4 (according to the invention) | Dipropylene glycol | Dodecanoic acid | x | 3.91 |
| Diester 5 (according to the invention) | Mono-propylene glycol | Dodecanoic acid | x | 3.36 |
| Diester 6 (prior art) | Neopentyl glycol | Nonanoic acid | x | 2.57 |
| Diester 7 (prior art) | Neopentyl glycol | Dodecanoic acid | x | 4.33 |

Example 1

Physicochemical Characterization of Lubricating Compositions According to the Invention and Comparative Compositions Tables 2 and 3 below show details of the lubricating compositions according to the invention and comparative compositions as well as their physicochemical characteristics.

Lubricating compositions are obtained by simply mixing the following components at room temperature:

Base oil 1 is a Group III base oil (kinematic viscosity at 100° C. measured according to ASTM D-556=4.11 $mm^2/s$) commercially available for example from SK under the trade name "Yubase 4+", Base oil 2 is a Group III base oil (kinematic viscosity at 100° C. measured according to ASTM D-556=6 $mm^2/s$) commercially available for example from SK under the trade name "Yubase 6", A conventional additive package 1 comprising a dispersant, detergents, an anti-wear additive, A conventional additive package 2, A conventional additive package 3, A conventional additive package 4, A viscosity index improver 1 which is a conventional hydrogenated polyisoprene styrene polymer commercially available from Infineum under the trade name "SV®", A viscosity index improver 2 which is a conventional hydrogenated polyisoprene styrene polymer commercially available from Infineum under the trade name "SV®", A viscosity index improver 3 which is a conventional polymethacrylate polymer commercially available from Evonik under the trade name "Viscoplex®", A friction modifier which is a conventional organomolybdenum compound commercially available from Adeka under the trade name "Sakuralube®", A pour point depressant additive which is a conventional polymethacrylate polymer commercially available from Evonik under the trade name "Viscoplex®", An amino antioxidant additive commercially available from BASF under the trade name "Irganox®"

In Table 2, the component contents for each lubricating composition are given in percentages by weight based on the total weight of the lubricating composition.

The properties of the lubricating compositions thus prepared are listed in the following Table 3.

TABLE 2

| | CC1 | CC2 | CC3 | C1 | CC4 | C2 | C3 | CC5 | CC6 | C4 | CC7 | CC8 | C5 |
|---|---|---|---|---|---|---|---|---|---|---|---|---|---|
| Base oil 1 | 82.6 | 66.9 | 66.9 | 66.9 | 80.9 | 64.4 | 64.9 | 66.4 | 66.4 | 56.7 | 57.1 | 64.0 | 48.8 |
| Base oil 2 | x | x | x | x | x | x | x | x | x | x | x | 15.0 | 15 |
| Additive package 1 | 9.4 | 9.4 | 9.4 | 9.4 | x | x | x | x | x | x | x | x | x |
| Additive package 2 | x | x | x | x | 10 | 10 | 10 | 10 | 10 | x | x | x | x |

TABLE 2-continued

| | CC1 | CC2 | CC3 | C1 | CC4 | C2 | C3 | CC5 | CC6 | C4 | CC7 | CC8 | C5 |
|---|---|---|---|---|---|---|---|---|---|---|---|---|---|
| Additive package 3 | x | x | x | x | x | x | x | x | x | 21.8 | 21.8 | x | x |
| Additive package 4 | x | x | x | x | x | x | x | x | x | x | x | 14.8 | 14.8 |
| Viscosity index improver 1 | 6.8 | 7.5 | 7.5 | 7.5 | x | x | x | x | x | x | x | 2.0 | 2.2 |
| Viscosity index improver 2 | x | x | x | x | 8.5 | 10 | 9.5 | 8 | 8 | x | x | x | x |
| Viscosity index improver 3 | x | x | x | x | x | x | x | x | x | 6.0 | 6.61 | 3.5 | 3.5 |
| Friction modifier | 0.5 | 0.5 | 0.5 | 0.5 | 0.6 | 0.6 | 0.6 | 0.6 | 0.6 | x | x | 0.5 | 0.5 |
| Pour point depressant additive | 0.2 | 0.2 | 0.2 | 0.2 | x | x | x | x | x | 0.3 | 0.3 | 0.2 | 0.2 |
| Antioxidant additive | 0.5 | 0.5 | 0.5 | 0.5 | x | x | x | x | x | x | x | x | x |
| Diester 1(prior art) | x | 15 | x | x | x | x | x | x | x | x | x | x | x |
| Diester 2 | x | x | x | x | x | x | x | x | 15 | x | 14.6 | x | x |
| Diester 3 (invention) | x | x | x | 15 | x | 15 | x | x | x | 7.5 | x | x | 15 |
| Diester 4 (invention) | x | x | x | x | x | x | x | x | x | 7.5 | x | x | x |
| Diester 5 (invention) | x | x | x | x | x | x | 15 | x | x | x | x | x | x |
| Diester 6 (prior art) | x | x | 15 | x | x | x | x | x | x | x | x | x | x |
| Diester 7 (prior art) | x | x | x | x | x | x | x | 15 | x | x | x | x | x |

TABLE 3

| Compo | CC1 | CC2 | CC3 | C1 | CC4 | C2 | C3 | CC5 | CC6 | C4 | CC7 | CC8 | C5 |
|---|---|---|---|---|---|---|---|---|---|---|---|---|---|
| KV 40° C. ASTM D445-97 ($mm^2/s$) | 44.46 | 41.13 | 41.49 | 41.22 | 31.20 | 28.6 | 29.4 | 30.0 | 30.0 | 29.7 | 29.9 | 43.03 | 39.43 |
| KV 100° C. ASTM D445-97 ($mm^2/s$) | 8.83 | 8.65 | 8.63 | 8.65 | 6.85 | 6.94 | 7.01 | 6.95 | 6.87 | 8.18 | 8.50 | 8.78 | 8.96 |
| Viscosity index (VI) ASTM D2270-93 | 182 | 196 | 193 | 195 | 187 | 218 | 214 | 205 | 200 | 271 | 284 | 189 | 218 |
| HTHS at 150° C. ASTM D 4683 (cP) | 2.60 | 2.64 | 2.60 | 2.57 | 2.29 | 2.30 | 2.31 | 2.31 | 2.30 | 2.62 | 2.65 | 2.90 | 2.92 |
| Volatility Noack ASTM D5800 (wt %) | 13.0 | 15.7 | 15.0 | 13.5 | 12.3 | 14.0 | 11.9 | 11.1 | ND | ND | ND | 11.5 | 13.3 |

ND: NOT DETERMINED

Example 2

Characterization of Compositions According to the Invention and Comparative Compositions in Terms of Fuel Economy ("Fuel-Eco")

The test is carried out using an EB 1.2 L Turbo engine with a power output of 81 kW at 5500 rpm, driven by an electric generator that can impose a rotation speed between 900 and 4500 rpm, while a torque sensor measures the friction torque generated by the movement of the parts in the engine. The friction torque induced by the test lubricant is compared for each speed and temperature to the torque induced by the reference lubricating composition (SAE 0W30).

The conditions for this test are as follows.

The tests are carried out in the following sequence:

flushing the engine with a flushing oil comprising detergent additives, followed by flushing with a reference lubricating composition;

measurement of the friction torque at the four different temperatures indicated below on the engine using the reference lubricating composition;

flushing the engine with a flushing oil comprising detergent additives, followed by flushing with a lubricating composition to be evaluated;

measurement of the friction torque at four different temperatures on the engine using the lubricating composition to be evaluated;

flushing the engine with a flushing oil comprising detergent additives, followed by flushing with the reference lubricating composition; and measurement of the friction torque at the four different temperatures shown below on the engine using the reference lubricating composition.

The speed ranges, speed variation and temperature were chosen to cover, as representatively as possible, the points of the NEDC.

The instructions implemented are:

Motor outlet water temperature: 35° C./50° C./80° C./100° C.±0.5° C.,

Oil temperature ramp: 35° C./50° C./80° C./110° C.±0.5° C.

The friction gain is evaluated for each lubricating composition (C1, CC1 to CC3) as a function of engine temperature and speed and in comparison with the friction of the reference lubricating composition.

The results of the "Fuel Eco" test are summarized in Table 4 below, and show the average percentage friction gains for each compound at a given temperature over a speed range from 900 rpm to 4500 rpm.

TABLE 4

| Average percentage friction gains at a temperature t of the lubricating composition | CC1 | CC2 | CC3 | C1 |
|---|---|---|---|---|
| t = 35° C. | 2.2 | 2.9 | 3.9 | 5.0 |
| t = 50° C. | 1.9 | 2.1 | 2.8 | 3.7 |

TABLE 4-continued

| Average percentage friction gains at a temperature t of the lubricating composition | CC1 | CC2 | CC3 | C1 |
|---|---|---|---|---|
| t = 80° C. | 0.8 | 0.2 | 1.4 | 1.6 |
| t = 110° C. | 0.9 | 0.3 | 0.5 | 1.0 |

These results show that the friction gains for the composition C1 comprising the ester according to the invention are much greater than the friction gains obtained with the comparative compositions CC1 comprising no ester, CC2 and CC3 comprising an ester different from those of the invention.

It is understood that the greater the friction gains, the greater the fuel economy or Fuel Eco. This therefore implies that the compositions according to the invention make it possible to increase the Fuel Eco as opposed to compositions comprising no ester or esters different from the esters of the invention.

Example 3

Characterization of Compositions According to the Invention and Comparative Compositions in Terms of Fuel Economy ("Fuel-Eco")

The test is performed using a Nissan HR12DDR engine, with a power output of 180 kW at 6500 rpm, driven by an electric generator that can impose a rotation speed between 1000 and 4400 rpm, while a torque sensor measures the friction torque generated by the movement of the parts in the engine. The frictional torque induced by the test lubricant is compared for each speed and temperature to the average torque induced by the reference lubricating composition (SAE 0W16) which was evaluated before and after the test lubricant.

The conditions for this test are as follows.

The tests are carried out in the following sequence:

- flushing the engine with a flushing oil comprising detergent additives, followed by flushing with a reference lubricating composition;
- measurement of the friction torque at the four different temperatures indicated below on the engine using the reference lubricating composition;
- flushing the engine with a flushing oil comprising detergent additives, followed by flushing with a lubricating composition to be evaluated;
- measurement of the friction torque at four different temperatures on the engine using the lubricating composition to be evaluated;
- flushing the engine with a flushing oil comprising detergent additives, followed by flushing with the reference lubricating composition; and
- measurement of the friction torque at the four different temperatures shown below on the engine using the reference lubricating composition.

The speed ranges, speed variation and temperature were chosen to cover, as representatively as possible, the points of the NEDC.

The instructions implemented are:

Motor outlet water temperature: 30° C./50° C.±0.5° C.,

Oil temperature ramp: 30° C./50° C.±0.5° C.,

The friction gain is evaluated for each lubricating composition (C2, C3, CC4 to CC6) as a function of engine temperature and speed and in comparison with the friction of the reference lubricating composition.

The results of the "Fuel Eco" test are summarized in Table 5 below and show the average percentage friction gains for each compound at a given temperature over a speed range from 1000 rpm to 4400 rpm:

TABLE 5

| Average percentage friction gains at a temperature t of the lubricating composition | CC4 | C2 | C3 | CC5 | CC6 |
|---|---|---|---|---|---|
| t = 30° C. | −0.14 | 1.8 | 1.30 | −0.75 | −0.07 |
| t = 50° C. | 0.56 | 1.51 | 1.14 | −0.77 | 0.39 |

These results show that the friction gains for compositions C2 and C3 comprising an ester according to the invention are much greater than the friction gains obtained with the comparative compositions CC4 comprising no ester and CC5 and CC6 comprising an ester different from those of the invention.

These results also show that the comparative compositions CC4 to CC6 do not show friction gains, but rather friction losses, which implies that the comparative compositions CC4 to CC6 do not allow for Fuel Eco but on the contrary lead to an overconsumption of fuel compared with the reference composition.

It is understood that the greater the friction gains, the greater the fuel economy or Fuel Eco. This therefore implies that the compositions according to the invention make it possible to increase the Fuel Eco as opposed to compositions comprising no ester or esters different from the esters of the invention, such as 2-ethylhexyl sebacate.

Example 4

Characterization of Compositions According to the Invention and Comparative Compositions in Terms of Fuel Economy ("Fuel-Eco") The test is carried out using a Honda L13-B engine, with a power of 81 kW at 5500 rpm, driven by an electric generator that can impose a rotation speed between 650 and 5000 rpm, while a torque sensor measures the friction torque generated by the movement of the parts in the engine. The frictional torque induced by the test lubricant is compared for each speed and temperature to the torque induced by the reference lubricating composition (SAE 0W16).

The conditions for this test are as follows.

The tests are carried out in the following sequence:

- flushing the engine with a flushing oil comprising detergent additives, followed by flushing with a reference lubricating composition;
- measurement of the friction torque at the four different temperatures indicated below on the engine using the reference lubricating composition;
- flushing the engine with a flushing oil comprising detergent additives, followed by flushing with a lubricating composition to be evaluated;
- measurement of the friction torque at four different temperatures on the engine using the lubricating composition to be evaluated;
- flushing the engine with a flushing oil comprising detergent additives, followed by flushing with the reference lubricating composition; and
- measurement of the friction torque at the four different temperatures shown below on the engine using the reference lubricating composition.

The speed ranges, speed variation and temperature were chosen to cover, as representatively as possible, the points of the NEDC.

The instructions implemented are:

Motor outlet water temperature: 35° C./50° C.±0.5° C.,

Oil temperature ramp: 35° C./50° C.±0.5° C.

The friction gain is evaluated for each lubricating composition (C4 and CC7) as a function of engine temperature and speed and in comparison with the friction of the reference lubricating composition.

The results of the "Fuel Eco" test are summarized in Table 5 below, and show the average percentage friction gains for each compound at a given temperature over a speed range from 650 rpm to 5000 rpm:

TABLE 6

| Average percentage friction gains at a temperature t of the lubricating composition | C4 | CC7 |
|---|---|---|
| t = 35° C. | 1.4 | 0.8 |
| t = 50° C. | 0.2 | −0.2 |

These results show that the friction gains for composition C4 comprising a mixture of esters according to the invention are much greater than the friction gains obtained with the comparative composition CC7 comprising, as ester, 2-ethylhexyl sebacate, different from those of the invention.

It is understood that the greater the friction gains, the greater the fuel economy or Fuel Eco. This therefore implies that the compositions according to the invention make it possible to increase the Fuel Eco as opposed to compositions comprising no ester or esters different from the esters of the invention, such as 2-ethylhexyl sebacate.

Example 5

Evaluation of the Engine Cleanliness Improving Properties of a Lubricating Composition According to the Invention C5 and a Comparative Lubricating Composition CC8

Engine cleanliness performance on lubricating compositions C5 and CC8 is evaluated using the following method.

Each lubricating composition (10 kg) is evaluated during a cleanliness test of a common rail diesel engine for automobiles. The engine has a displacement of 1.4 L for 4 cylinders. Its power is 80 kW. The test cycle time is 96 hours with alternating idle and 4000 rpm. The temperature of the lubricating composition is 145° C. and the water temperature of the cooling system is 100° C. No draining or topping up of lubricating composition is carried out during the test. EN 590 fuel is used.

The test is carried out in two phases for a total duration of 106 hours and in a first stage of rinsing and running-in for 10 hours, then in a second stage with the evaluated composition (4 kg), and finally in an endurance stage lasting 96 hours with the evaluated composition (4 kg).

After this test, the engine parts were analyzed and the 4 pistons rated according to the European standard CEC M02A78. For each piston, its merit rating is made and then an average of the total piston merit rating of the 4 pistons is calculated.

The results obtained are grouped in Table 6.

The regular passage of a reference oil showed that a difference of 4 points between two candidates is significant.

The higher the value of the average merit rating, the better the cleanliness of the piston and therefore the better the performance of the lubricating composition to improve engine cleanliness.

TABLE 7

| Evaluated composition | Piston merit rating after test (%) |
|---|---|
| C5 | 66.71 |
| CC8 | 61.6 |

The results show that the use of an ester according to the invention in a lubricating composition improves the cleanliness of an engine (lubricating composition C5) compared with a comparative lubricating composition comprising no ester according to the invention (lubricating composition CC8).

The invention claimed is:

1. A lubricating composition of grade according to the SAE J300 classification defined by formula (X)W(Y), wherein X represents 0 or 5; and Y represents an integer ranging from 4 to 20; said composition comprising at least one diester of formula (I):

$$R^a—C(O)—O—([C(R)_2]_n—O)_s—C(O)—R^b \quad (I)$$

wherein:

R independently represent a hydrogen atom or a linear or branched $(C_1\text{-}C_5)$alkyl;

s is 1, 2, 3, 4, 5 or 6;

n is 1, 2 or 3; it being understood that, when s is different from 1, n may be the same or different; and $R^a$ and $R^b$, which may be identical or different, independently represent saturated or unsaturated, linear or branched hydrocarbon groups having a linear chain of 6 to 18 carbon atoms;

provided that, when s is 2 and n, which are identical, are 2, at least one of the groups R represents a linear or branched $(C_1\text{-}C_5)$alkyl group; and provided that, when s is 1 and n is 3, at least one of the groups R bonded to the carbon in the beta position of the oxygen atoms of the ester functions represents a hydrogen atom.

2. The composition as claimed in claim 1, wherein $R^a$ and $R^b$, which may be identical or different, have a linear sequence of 7 to 14 carbon atoms.

3. The composition as claimed in claim 1, wherein $R^a$ and $R^b$, which may be identical or different, represent $C_6$ to $C_{18}$ linear alkyl groups.

4. The composition as claimed in claim 1, wherein $R^a$ and $R^b$ both represent n-octyl or n-undecyl groups.

5. The composition as claimed in claim 1, wherein the diester is of the following formula (I')

$$R^a—C(O)—O—[C(R)_2]_n—O)—([C(R')_2]_m—O)_{s-1}—C(O)—R^b \quad (I')$$

wherein:

R and R' independently represent a hydrogen atom or a linear or branched $(C_1\text{-}C_5)$alkyl group;

s is 1, 2 or 3;

n is 2;

m is 2;

$R^a$ and $R^b$, which may be identical or different, independently represent saturated or unsaturated, linear or branched hydrocarbon groups having a linear chain of 6 to 18 carbon atoms;

provided that, when s is 2, at least one of the groups R or R' represents a linear or branched $(C_1\text{-}C_5)$alkyl group.

6. The composition as claimed in claim 5, wherein the diester is of formula (I') wherein:

s is 2, one of the groups R represents a linear or branched ($C_1$-$C_5$)alkyl group; and one of the groups R' represents a linear or branched ($C_1$-$C_5$)alkyl group; the other groups R and R' representing hydrogen atoms.

7. The composition as claimed in claim 5, wherein:

s is equal to 1;

one of the groups R represents a linear or branched ($C_1$-$C_5$)alkyl group, the others representing hydrogen atoms.

8. The composition as claimed in claim 1, wherein the diester is obtained by esterification reaction between a monopropylene or polypropylene glycol; and one or more carboxylic acids $R^a$—COOH and $R^b$—COOH.

9. The composition as claimed in claim 1, said composition comprising from 1 to 30 wt % diester(s) of formula (I) based on the total weight of the composition.

10. The composition as claimed in claim 1, said composition comprising one or more base oils selected from the oils of Groups II, III and IV of the API classification.

11. The composition as claimed in claim 1, comprising one or more additives selected from friction modifying additives, anti-wear additives, extreme pressure additives, detergent additives, antioxidant additives, viscosity index improvers, pour point depressants, dispersing agents, anti-foam agents, thickeners, and mixtures thereof.

12. The composition as claimed in claim 1, comprising at least one friction-modifying additive.

13. The composition as claimed in claim 1, of grade according to the SAE J300 classification selected from 0W4, 0W8, 0W12, 0W16, 0W20, 5W4, 5W8, 5W12, 5W16 and 5W20.

14. A method for lubricating an engine using a lubricating composition of grade according to the SAE J300 classification defined by formula (X)W(Y), wherein X represents 0 or 5; and Y represents an integer ranging from 4 to 20; said composition comprising at least one diester of formula (I):

$$R^a—C(O)—O—([C(R)_2]_n—O)_s—C(O)—R^b \quad (I)$$

wherein:

R independently represent a hydrogen atom or a linear or branched ($C_1$-$C_5$)alkyl group;

s is 1, 2, 3, 4, 5 or 6;

n is 1, 2 or 3; it being understood that, when s is different from 1, n may be the same or different; and $R^a$ and $R^b$, which may be identical or different, independently represent saturated or unsaturated, linear or branched hydrocarbon groups having a linear chain of 6 to 18 carbon atoms;

provided that, when s is 2 and n, which are identical, are 2, at least one of the groups R represents a linear or branched ($C_1$-$C_5$)alkyl group; and provided that, when s is 1 and n is 3, at least one of the groups R bonded to the carbon in the beta position of the oxygen atoms of the ester functions represents a hydrogen atom.

15. A method for reducing the fuel consumption of the engine, using a lubricating composition of grade according to the SAE J300 classification defined by the formula (X)W(Y), wherein X represents 0 or 5, and Y represents an integer ranging from 4 to 20 and dedicated to an engine, comprising as additive a diester of formula (I)

$$R^a—C(O)—O—([C(R)_2]_n—O)_s—C(O)—R^b \quad (I)$$

wherein:

R independently represent a hydrogen atom or a linear or branched ($C_1$-$C_5$)alkyl group;

s is 1, 2, 3, 4, 5 or 6;

n is 1, 2 or 3; it being understood that, when s is different from 1, n may be the same or different; and $R^a$ and $R^b$, which may be identical or different, independently represent saturated or unsaturated, linear or branched hydrocarbon groups having a linear chain of 6 to 18 carbon atoms;

provided that, when s is 2 and n, which are identical, are 2, at least one of the groups R represents a linear or branched ($C_1$-$C_5$)alkyl group; and provided that, when s is 1 and n is 3, at least one of the groups R bonded to the carbon in the beta position of the oxygen atoms of the ester functions represents a hydrogen atom.

16. A method for improving engine cleanliness, using a lubricating composition of grade according to the SAE J300 classification defined by the formula (X)W(Y), wherein X represents 0 or 5, and Y represents an integer ranging from 4 to 20, and dedicated to an engine, comprising as additive a diester of formula (I)

$$R^a—C(O)—O—([C(R)_2]_n—O)_s—C(O)—R^b \quad (I)$$

wherein:

R independently represent a hydrogen atom or a linear or branched ($C_1$-$C_5$)alkyl group;

s is 1, 2, 3, 4, 5 or 6;

n is 1, 2 or 3; it being understood that, when s is different from 1, n may be the same or different; and $R^a$ and $R^b$, which may be identical or different, independently represent saturated or unsaturated, linear or branched hydrocarbon groups having a linear chain of 6 to 18 carbon atoms;

provided that, when s is 2 and n, which are identical, are 2, at least one of the groups R represents a linear or branched ($C_1$-$C_5$)alkyl group; and provided that, when s is 1 and n is 3, at least one of the groups R bonded to the carbon in the beta position of the oxygen atoms of the ester functions represents a hydrogen atom.

* * * * *